US011430364B1

(12) United States Patent
Hsieh et al.

(10) Patent No.: US 11,430,364 B1
(45) Date of Patent: Aug. 30, 2022

(54) DISPLAY PANEL AREA REFRESH RATES

(71) Applicant: Hewlett-Packard Development Company, L.P., Spring, TX (US)

(72) Inventors: Hsing-Hung Hsieh, Taipei (TW); Super Liao, Taipei (TW); Hang Yan Yuen, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/501,278

(22) Filed: Oct. 14, 2021

(51) Int. Cl.
*G09G 3/20* (2006.01)

(52) U.S. Cl.
CPC ..... *G09G 3/20* (2013.01); *G09G 2310/08* (2013.01); *G09G 2320/0261* (2013.01); *G09G 2330/021* (2013.01)

(58) Field of Classification Search
CPC ..... G09G 3/20; G09G 2310/08; G09G 2320/0261; G09G 2330/021
See application file for complete search history.

(56) References Cited

U.S. PATENT DOCUMENTS

| | | | | |
|---|---|---|---|---|
| 8,115,726 | B2 | 2/2012 | Tsai | |
| 2019/0287450 | A1* | 9/2019 | Urabe | H04N 9/646 |
| 2019/0287477 | A1* | 9/2019 | Tomie | G09G 3/3688 |

* cited by examiner

*Primary Examiner* — Sejoon Ahn
(74) *Attorney, Agent, or Firm* — Brooks Cameron & Huebsch PLLC

(57) ABSTRACT

In some examples, a computing device can include a processor resource and a non-transitory memory resource storing machine-readable instructions to cause the processor resource to receive a signal from a graphics processing unit, cause, based on the signal, a first portion of image data to be sent to a first pixel on a moving image area of the display panel at a first refresh rate over a plurality of frames in response to a first thin film transistor (TFT) associated with the first pixel being on, and cause, based on the signal, a second portion of the image data to be sent to a second pixel on a static image area of the display panel at a second refresh rate over the plurality of frames.

15 Claims, 4 Drawing Sheets

DISPLAY PANEL AREA REFRESH RATES

BACKGROUND

A display device may include a display panel to display information. Such information may be displayed by the display device in response to receiving an electrical signal provided to the display device from another device. The information displayed may include text, videos, and/or images, among other types of information.

DETAILED DESCRIPTION

Figure 1:
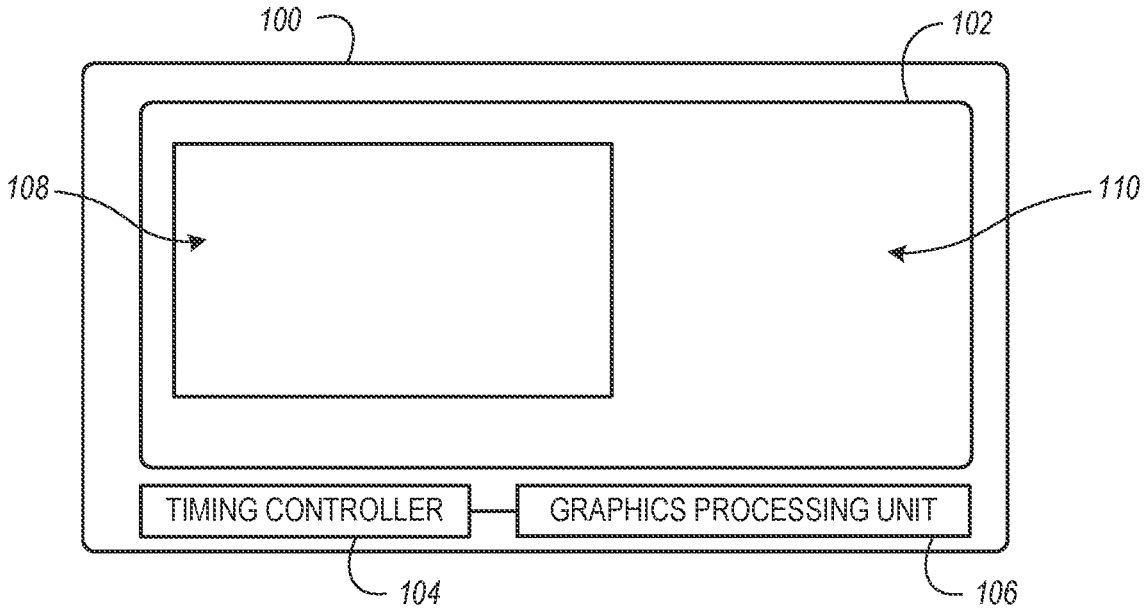
FIG. 1 is an example of a display device having a display panel with a moving image area and a static image area for display panel area refresh rates consistent with the disclosure.

A display device can display information in response to receiving an electrical signal. As used herein, the term "display device" refers to an output device that includes a display panel that displays information provided by an electrical signal in a visual and/or tactile form. As used herein, the term "display panel" refers to an area of a display device that displays information. For example, a display device can have a display panel that can display information such as text, videos, images, or combinations thereof as a result of an electrical signal provided to the display from another device, such as a computing device, among other examples.

When a display device displays information on the display panel of the display device, the display device updates the information displayed on the display panel at a particular refresh rate. As used herein, the term "refresh rate" refers to an amount of times a display panel is updated per time period. For example, the display panel can update the information displayed on the display panel per a time period (e.g., every second) to result in the display panel refreshing at a particular frequency.

Some information displayed on the display panel can be moving image data. For example, moving image data such as a video can be displayed on the display panel. Other information displayed on the display panel can be static image data. For instance, static image data such as text or an image can be displayed on the display panel. In some examples, both moving image data and static image data can be displayed simultaneously in different areas of the display panel.

Static image data displayed on the display panel may not change as often as moving image data. For example, the moving image data may be a video, and the display panel may continuously update the moving image data so as to animate the video for viewing by a user of the display device. Additionally, the display panel may include static image data that can be located adjacent to the moving image data, such as a title of the video.

Such static image data may not have to be refreshed as often as moving image data. Accordingly, a controller may update moving image data at a particular refresh rate but reproduce the static image data from its memory at the same particular refresh rate. However, such an approach may not provide power savings over refreshing the static image data and the moving image data at the same refresh rate without reproduction of the static image data from the controller's memory.

Display panel area refresh rates according to the disclosure can allow for refresh of an area of a display panel that is displaying moving image data at a first refresh rate and refresh of another area of the display panel displaying static image data at a second refresh rate that is less than the first refresh rate. Such an approach can allow for power savings of the display device as compared with previous approaches, as a controller does not have to reproduce image information from its memory, as is further described herein.

FIG. 1 is an example of a display device 100 having a display panel 102 with a moving image area 108 and a static image area 110 for display panel area refresh rates consistent with the disclosure. The display device 100 can further include a timing controller 104 and a graphics processing unit 106.

A display device 100 can include a display panel 102. The display device 100 can be, for example, a low temperature polysilicon (LTPS) display, an oxide thin-film transistor (TFT) display, among other types of display devices.

As mentioned above, the display panel 102 can display information for viewing by a user of the display device 100 provided to the display device 100 via an electrical signal. The electrical signal can be received by, for instance, a graphics processing unit (GPU) 106. As used herein, the term "GPU" refers to an electronic circuit to manipulate and alter memory to accelerate creation of images for output to a display device. For example, the GPU 106 can receive an electrical signal from, for instance, a computing device, where the GPU 106 can assist in creation of images from the electrical signal for display on the display panel 102 of the display device 100.

The display panel 102 can be refreshed an amount of times per unit of time to display information data on the display panel 102. Such amount of times per unit of time can define a refresh rate of the display panel 102. In some examples, the display panel 102 can be refreshed 60 times per second, which can define a refresh rate of 60 Hertz (Hz) for the display panel 102. However, examples of the disclosure are not so limited. For example, the display panel 102 may be refreshed at a refresh rate other than that of 60 Hz (e.g., faster than 60 Hz or slower than 60 Hz). Additionally, certain areas of the display panel 102 may be refreshed at different rates, as is further described herein.

In order for the display panel 102 to display information for viewing by a user, the display device 100 can include a timing controller 104. The timing controller 104 can be a controller that can drive individual pixel components of the display panel 102 by utilizing source data lines connecting each individual pixel component to the timing controller 104. As used herein, the term "source data line" refers to electrical circuitry through which electric current can flow. For example, the timing controller 104 can utilize information received from the GPU 106 and cause information, such as moving image data and/or static image data, to be displayed on the display panel 102 by sending and/or preventing image data to be sent across the source data lines to various pixels on the display panel 102, as is further described herein.

In order to display moving image data and/or static image data on the display panel 102, the timing controller 104 can receive a signal from the GPU 106. As used herein, the term "signal" refers to a function that conveys information. The signal from the GPU 106 can include information about data to be displayed on the display panel 102.

In an instance in which the data to be displayed on the display panel 102 includes moving image data and static image data, the signal from the GPU 106 can define a static image area 110 and a moving image area 108 on the display panel 102. For example, a user of the display device 100 may wish to watch a video via a web browser. The video may include moving image data (e.g., the video itself), but other portions of the web browser may include static image data such as the title of the video, categorization information about the video (e.g., genre, length, creation date, etc.), identifying information about a user who created the video, etc.

The signal from the GPU 106 can define areas (e.g., collections of pixels) on the display panel 102 in which the moving image data and the static image data are to be displayed (e.g., via the collections of pixels). For example, the timing controller 104 can receive the signal from the GPU 106 which defines the moving image area 108 having a first plurality of pixels on the display panel 102 and the static image area 110 having a second plurality of pixels on the display panel 102. As used herein, the term "static image area" refers to a portion of a display panel on which information that is stationary is displayed. As used herein, the term "moving image area" refers to a portion of a display panel on which information that changing is displayed. For example, the timing controller 104 can receive the signal from the GPU which includes data regarding a video, where the video is included in a web browser that includes a title of the video, a username of a user who created the video, and the length of the video. The video can be moving image data to be displayed in the moving image area 108 (e.g., via the first plurality of pixels) of the display panel 102 and the title of the video, the username of the user who created the video, and the length of the video can be static image data to be displayed in the static image area 110 (e.g., via the second plurality of pixels) of the display panel 102. Since the static image data does not change as often as the moving image data, the static image area 110 can be refreshed at a refresh rate that is less than the moving image area 108, which can save power for the display device 100 (e.g., relative to refreshing the moving image area 108 and the static image area 110 at the same refresh rate), as is further described herein.

The static image data and the moving image data can be displayed utilizing the first plurality of pixels and the second plurality of pixels across a plurality of frames. As used herein, the term "frame" refers to a still image. With respect to moving image data, in the example of the video described above, the data can consist of a plurality of frames (e.g., still images) making up the video that, when viewed in order and at a particular speed, animate the video. With respect to static image data, the data can consist of a plurality of frames showing the title of the video, the username of the user who created the video, and the length of the video.

Accordingly, the timing controller 104 can cause, based on the signal, a first portion of the image data (e.g., that includes the moving image data) to be sent to pixels on the moving image area 108 of the display panel 102 at a first refresh rate in response to thin-film transistors (TFTs) associated with the pixels in the moving image area 108 being on. As used herein, the term "thin-film transistor" refers to a metal-oxide-semiconductor field-effect transistor (MOSFET) that comprises thin films of an active semiconductor layer as well as a dielectric layer and metallic contacts on a supporting substrate. For example, a particular pixel in the moving image area 108 can be connected to the timing controller 104 via a source data line including a TFT. The timing controller 104 can cause a first portion of image data (e.g., a still image of the video) to be sent to the particular pixel in the moving image area 108 across the source data line and the TFT connecting the particular pixel in the moving image area 108 with the timing controller 104.

Figure 3:
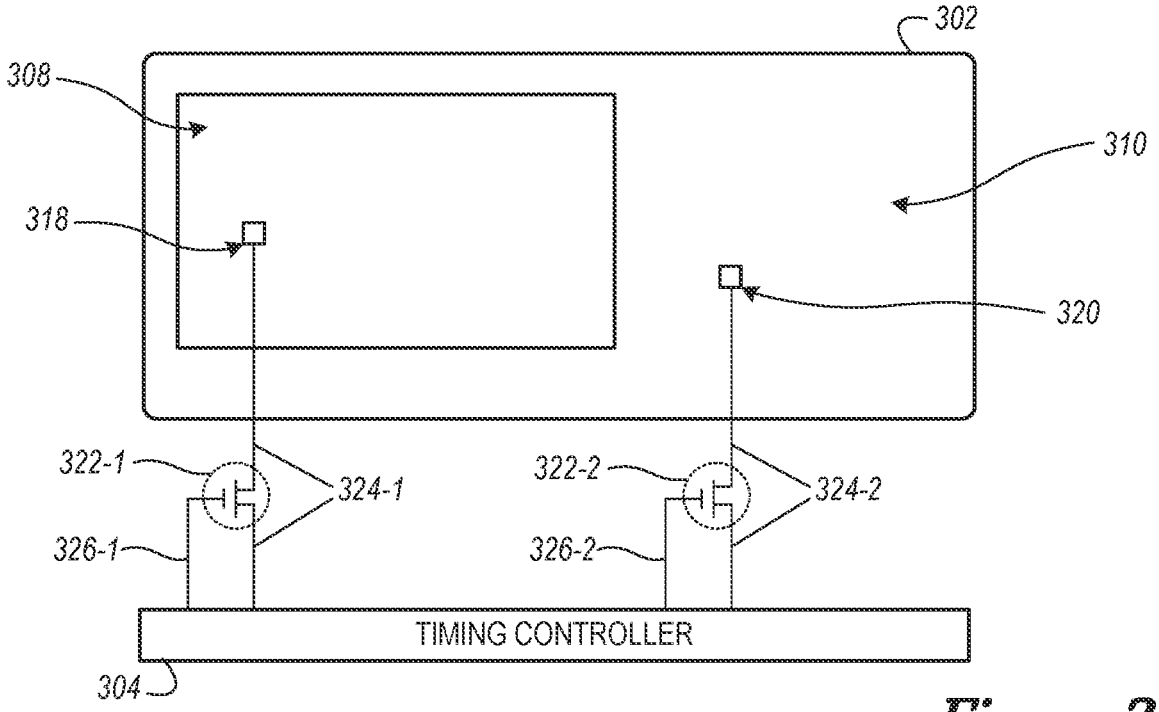
FIG. 3 is an example of a display panel including source data lines and TFTs connected to various pixels for display panel area refresh rates consistent with the disclosure.
Figure 4:
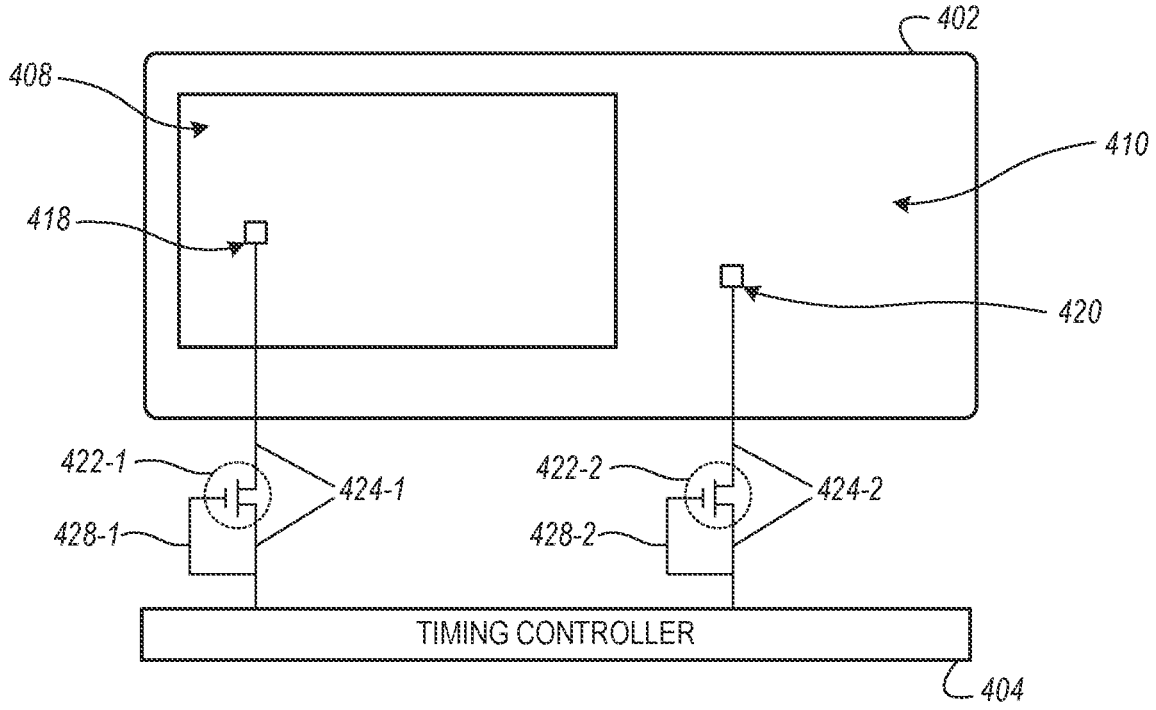
FIG. 4 is an example of a display panel including source data lines and TFTs connected to various pixels for display panel area refresh rates consistent with the disclosure.

Additionally, the timing controller can cause, based on the signal, a second portion of the image data (e.g., that includes the static image data) to be sent to pixels on the static image area 108 of the display panel 102 at a second refresh rate based on TFTs associated with the pixels in the static image area 108 being turned on and off, as is further described herein and with respect to FIGS. 3 and 4. For example, a particular pixel in the static image area 110 can be connected to the timing controller 104 via a source data line including a TFT. The timing controller 104 can cause a second portion of the image data (e.g., a first still image of the title of the video, the username of the user who created the video, and the length of the video to be sent to and displayed on the static image area 110) to be sent to the particular pixel in the static image area 110 across the source data line and the TFT connecting the particular pixel in the static image area 110 and the timing controller 104, For example, the timing controller 104 can send, in response to the TFT on the source data line connecting the particular pixel in the static image area 110 and the TFT being on, the second portion of the image data to the particular pixel during the first frame.

During a second frame of the plurality of frames, the first portion of the image data (e.g., that includes the moving image data) can be sent to the display panel to be displayed on the moving image area 108 based on the signal. For example, the timing controller 104 can cause a second still image of the video to be sent to and displayed on the moving image area 108.

Since the static image data does not change, the timing controller 104 can prevent, based on the TFT on the source data line connecting the particular pixel in the static image area 110, the second portion of the image data from being sent to the display panel 102 by turning the TFT off. That is, the still image of the title of the video, the username of the user who created the video, and the length of the video displayed on the static image area 110 is not updated and merely maintains the previous state (e.g., displaying the still image of the title of the video, the username of the user who created the video, and the length of the video). The timing controller 104 can cause the second portion of the image data (e.g., the static image data) to be displayed (e.g., maintain the previous state) on the static image area 110 over a plurality of frames until it is refreshed (e.g., updated).

In an example in which the refresh rate is 60 Hz, the plurality of frames may be 60. The timing controller 104 may therefore cause the moving image data (e.g., the first portion of the image data received from the GPU 106) to refresh every frame (e.g., 60 times) over the course of one second. However, since the static image data is not changing (e.g., at all or as quickly as the moving image data), the timing controller 104 may cause the static image data (e.g., the second portion of the image data received from the GPU 106) to refresh every third frame (e.g., 20 times) over the course of one second by causing TFTs on the source data lines connecting the pixels in the static image area 110 and the timing controller 104 to be on and/or off. As a result, the timing controller 104 can allow for an effective refresh rate of the moving image area 108 to be 60 Hz, whereas the effective refresh rate of the static image area 110 can be 20 Hz. Preventing the refresh rate of the static image area 110 can allow for power savings as compared with previous approaches as the timing controller 104 can refresh the static image area 110 at a refresh rate that is less than the moving image area 108.

Figure 2:
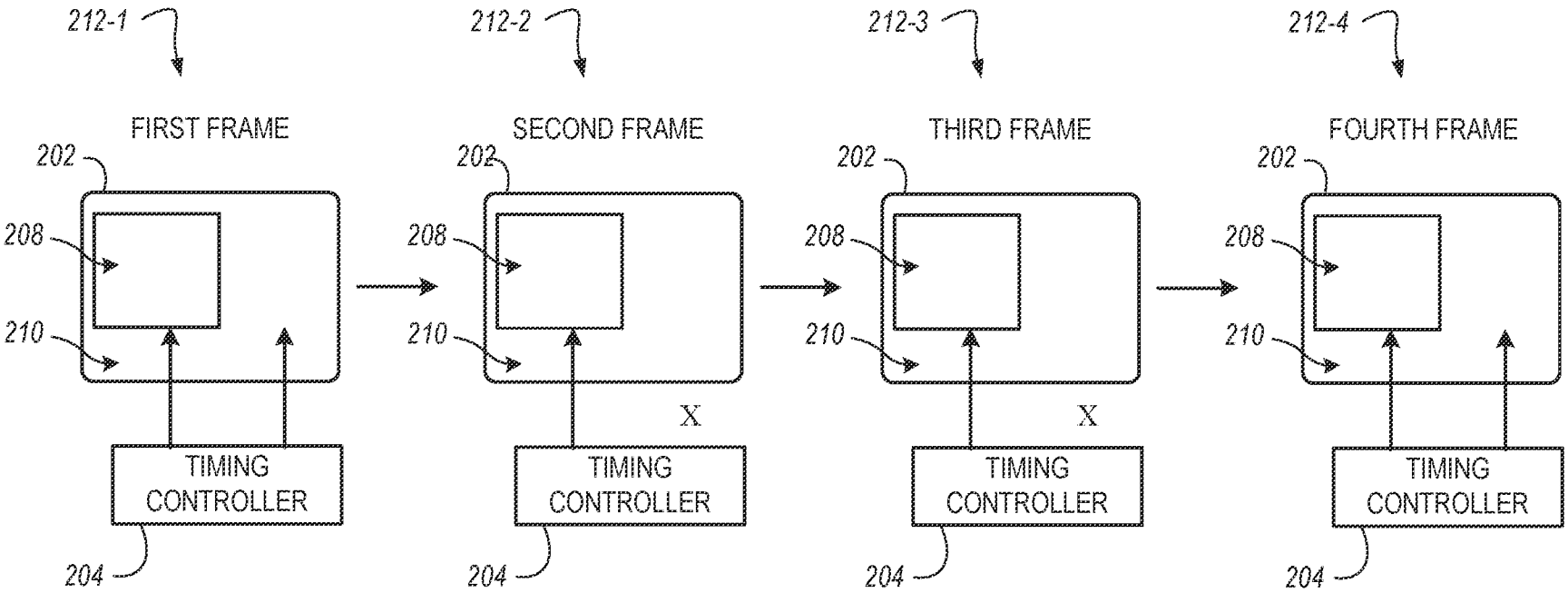
FIG. 2 is an example of a display panel over a plurality of frames for display panel area refresh rates consistent with the disclosure.

FIG. 2 is an example of a display panel 202 over a plurality of frames 212 for display panel area refresh rates consistent with the disclosure. As illustrated in FIG. 2, the timing controller 204 can transmit image data to different portions of the display panel 202 during different frames 212.

As previously described in connection with FIG. 1, the timing controller 204 can transmit moving image data and static image data to the display panel 202 during certain frames 212. Additionally, the timing controller 204 can prevent transmission of static image data to the display panel 202 during certain frames 212. Such transmission of image data can result in an effective refresh rate that can differ based on the image area of the display panel 202, as is further described herein.

For example, at a first frame 212-1, the timing controller 204 can transmit a first portion of image data (e.g., moving image data) at a first refresh rate by causing the moving image data to be sent to be displayed on the moving image area 208. Additionally, the timing controller 204 can transmit a second portion of image data (e.g., static image data) by causing, during the first frame 212-1, the static image data to be sent to be displayed on the static image area 210.

At the second frame 212-2, the timing controller 204 can again cause the first portion of the image data (e.g., the moving image data) to be sent to be displayed on the moving image area 208, where the second frame 212-2 is subsequent to the first frame 212-1. However, the timing controller 204 can refrain from transmitting the second portion of the image data (e.g., the static image data) during the second frame 212-2 to be displayed on the static image area 210. Rather, the previous state of the static image area 210 can be maintained during the second frame 212-2.

At the third frame 212-3, the timing controller can again cause the first portion of the image data (e.g., the moving image data) to be sent to be displayed on the moving image area 208, where the third frame 212-3 is subsequent to the first frame 212-1 and the second frame 212-2. The timing controller 204 can again refrain from transmitting the second portion of the image data (e.g., the static image data) during the third frame 212-3 to be displayed on the static image area 210. The previous state of the static image area 210 can again be maintained during the third frame 212-3.

At the fourth frame 212-4, the timing controller can further cause the first portion of the image data (e.g., the moving image data) to be sent to be displayed on the moving image area 208, where the fourth frame 212-4 is subsequent to the first frame 212-1, the second frame 212-2, and the third frame 212-3. However, at the fourth frame 212-4, the timing controller 204 can transmit the second portion of image data (e.g., static image data) by causing, during the fourth frame 212-4, the static image data to be sent to be displayed on the static image area 210.

The timing controller 204 can cause the moving image area 208 to be refreshed at 60 Hz by transmitting the moving image data to the moving image area 208 every frame (e.g., over 60 frames). Further, the timing controller 204 can effectively cause the static image area 210 to be refreshed at 20 Hz by transmitting the static image data to the static image area 210 every third frame (e.g., 20 frames). The timing controller 204 can cause the moving image area 208 and the static image area 210 to be updated at different refresh rates by utilizing TFTs, as is further described in connection with FIGS. 3 and 4.

FIG. 3 is an example of a display panel 302 including source data lines 324 and TFTs 322 connected to various pixels 318, 320 for display panel area refresh rates consistent with the disclosure. As illustrated in FIG. 3, the display panel 302 includes a moving image area 308 including a pixel 318 and a static image area 310 including a pixel 320.

The timing controller 304 can be connected to the pixel 318 via a source data line 324-1. Additionally, the timing controller 304 can be connected to the pixel 320 via the source data line 324-2. As illustrated in FIG. 3, the source data line 324-1 includes a TFT 322-1 and the source data line 324-2 includes a TFT 322-2. The TFT 322-1 can include a select signal input 326-1 and the TFT 322-2 can include a select signal input 326-2. As used herein, the term "select signal input" refers to electrical circuitry through which electric current can flow. The select signal inputs 326-1 and 326-2 can be connected to respective gates of TFT 322-1 and TFT 322-2. Since the pixel 320 is included in the static image area 310, the timing controller 304 can turn the TFT 324-2 on or off by transmitting a signal to the TFT 322-2 via the select signal input 326-2, as is further described herein.

As previously described in connection with FIG. 1, the timing controller 304 can cause a first portion of image data (e.g., moving image data) to be sent to pixel 318 on the moving image area 308 during a first frame. For example, when the TFT 322-1 is on (e.g., is receiving a select signal from the timing controller 304 via the select signal input 326-1), the timing controller 304 can send a first portion of image data to the pixel 318 via the source data line 324-1 and the TFT 322-1. The timing controller 304 can send the first portion of image data to the pixel 318 via the source data line 324-1 and the TFT 322-1 during a second frame (e.g., and other subsequent) frames in order to cause the pixel 318 to be updated at a first refresh rate.

The timing controller 304 can transmit a select signal to the TFT 322-2 via the select signal input 326-2 to cause the TFT 322-2 to be on during the first frame. As such, the timing controller 304 can cause a second portion of image data (e.g., static image data) to be sent to pixel 320 on the static image area 310 during the first frame. For example, when the TFT 322-2 is on (e.g., is receiving a select signal from the timing controller 304), the timing controller 304 can send the second portion of image data to the pixel 320 via the source data line 324-2 and the TFT 322-2.

During a subsequent frame to the first frame (e.g., during a second frame), the timing controller 304 can refrain from transmitting the select signal to the TFT 322-2 via the select signal input 326-2 to cause the TFT 322-2 to be off (based on the received source signal from a GPU, not illustrated in FIG. 3), For example, the timing controller 304 determines, based on the received source signal from the GPU indicating static image data is included in a second portion of image data, the timing controller 304 is to refrain from sending the static image data to pixel 320 during the second frame. As such, the timing controller 304 can prevent the second portion of image data (e.g., static image data) from being sent to pixel 320 on the static image area 310 during the second frame. For example, when the TFT 322-2 is off (e.g., is not receiving a select signal from the timing controller 304), the timing controller 304 can prevent the second portion of image data from being sent to the pixel 320 via the source data line 324-2 and the TFT 322-2. The timing controller 304 may prevent the second portion of image data from being sent to the pixel 320 by turning off the TFT 322-2 during various frames in order to cause the second portion of the image data to be sent to the pixel 320 at a second refresh rate that is lower than the first refresh rate.

Although the moving image area 308 is illustrated in FIG. 3 as including one pixel 318 having a source data line 324-1 and a TFT 322-1 and the static image area 310 is illustrated in FIG. 3 as including one pixel 320 having a source data line 324-2 and a TFT 322-2, examples of the disclosure are not so limited. For example, the moving image area 308 can include a plurality of pixels, each having a source data line and an associated TFT. Further, the static image area 310 can include a plurality of pixels, each having a source data line and an associated TFT.

Further, while the moving image area 308 and the static image area 310 are illustrated in their respective positions on the display panel 302 in FIG. 3, examples of the disclosure are not so limited. For example, the moving image area 308 may be moved around on the display panel 302, increased in size, decreased in size, etc., resulting in the size and position of the static image area 310 to be correspondingly changed.

FIG. 4 is an example of a display panel including source data lines and TFTs connected to various pixels for display panel area refresh rates consistent with the disclosure. As illustrated in FIG. 4, the display panel 402 includes a moving image area 408 including a pixel 418 and a static image area 410 including a pixel 420.

Similar to the example described in FIG. 3, the timing controller 404 can be connected to the pixel 418 via a source data line 424-1. Additionally, the timing controller 404 can be connected to the pixel 420 via the source data line 424-2. As illustrated in FIG. 4, the source data line 424-1 includes a TFT 422-1 and the source data line 424-2 includes a TFT 422-2.

The TFT 422-4 can include a data terminal input 428-1 and the TFT 422-2 can include a data terminal input 428-2. As used herein, the term "data terminal input" refers to electrical circuitry through which electric current can flow. The data terminal inputs 428-1 and 428-2 can be connected to respective gates of TFT 422-1 and TFT 422-2 as well as the source data lines 424-1, 424-2 respectively. Since the pixel 420 is included in the static image area 410, the timing controller 404 can turn the TFT 424-2 on or off by modifying a data voltage of the source data line 424-2, as is further described herein.

As previously described in connection with FIG. 1, the timing controller 404 can cause a first portion of image data (e.g., moving image data) to be sent to pixel 418 on the moving image area 408 during a first frame. The timing controller 404 can cause the TFT 422-1 to be on when a data voltage is above a threshold voltage. For example, when the timing controller 404 provides a voltage on the source data line 424-1 that is above a threshold voltage (e.g., 0 volts (V)), the data terminal input 428-1 can detect the voltage above the threshold voltage and cause the TFT 422-1 to be on so that the timing controller 404 can send a first portion of image data to the pixel 418 via the source data line 424-1 and the TFT 422-1. The timing controller 404 can send the first portion of image data to the pixel 418 via the source data line 424-1 and the TFT 422-1 during a second frame (e.g., and other subsequent) frames in order to cause the pixel 418 to be updated at a first refresh rate.

The timing controller 404 can provide a voltage on the source data line 424-2 that is above the threshold voltage such that the data terminal input 428-2 can detect the voltage above the threshold voltage and cause the TFT 422-2 to be on during the first frame. As such, the timing controller 404 can cause a second portion of image data (e.g., static image data) to be sent to pixel 420 on the static image area 410 during the first frame. For example, when the TFT 422-2 is on (e.g., is detecting a voltage on the source data line 424-2 via the data terminal input 428-2), the timing controller 404 can send the second portion of image data to the pixel 420 via the source data line 424-2 and the TFT 422-2.

During a subsequent frame to the first frame (e.g., during a second frame), the timing controller 404 can refrain from providing a voltage to the source data line 424-2 such that the data terminal input 428-2 does not detect a voltage above a threshold voltage to cause the TFT 322-2 to be off (based on the received source signal from a GPU, not illustrated in FIG. 4). For example, the timing controller 404 determines, based on the received source signal from the GPU indicating static image data is included in a second portion of image data, the timing controller 404 is to prevent the static image data from being sent to pixel 420 during the second frame. The timing controller 404 can cause the data voltage to be below the threshold voltage, resulting in the TFT 422-2 being off. As such, the timing controller 404 can prevent the second portion of image data (e.g., static image data) from being sent to pixel 420 on the static image area 410 during the second frame. For example, when the TFT 422-2 is off (e.g., when the data terminal input 428-1 does not detect a data voltage above a threshold voltage), the timing controller 404 can prevent the second portion of image data from being sent to the pixel 420 via the source data line 424-2 and the TFT 422-2. The timing controller 404 may prevent the second portion of image data from being sent to the pixel 420 by turning off the TFT 422-2 during various frames in order to cause the second portion of the image data to be sent to the pixel 420 at a second refresh rate that is lower than the first refresh rate.

Accordingly, data voltages can be utilized to turn on or off the TFT 424-2 in order to send or prevent from sending image data to pixel 420 in the static image area of the display panel 402. When the timing controller 404 is to refresh the pixel 420 (e.g., during a particular frame), the timing controller 404 can provide a voltage on the source data line 424-2 that is detected by the data terminal input 428-2 causing the TFT 424-2 to turn on and allowing the timing controller 404 to send the second portion of image data to the pixel 420. During a subsequent frame, the timing controller 404 can remove the voltage on the source data line 424-2, turning off the TFT 422-2 and breaking the source data line 424-2 to the pixel 420, resulting in a refresh rate of the pixel 420 that is lower than the refresh rate of pixel 418.

Figure 5:
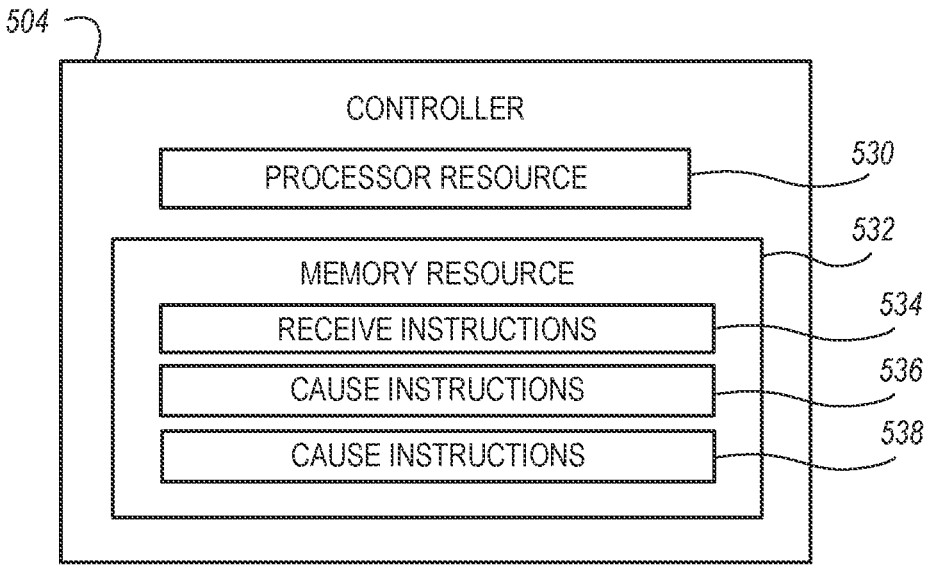
FIG. 5 is an example of a controller for display panel area refresh rates consistent with the disclosure.

FIG. 5 is an example of a controller 504 for display panel area refresh rates consistent with the disclosure. As described herein, the controller 504 may perform functions related to display panel area refresh rates. The controller 504 may include a processor resource 530 and a machine-readable storage medium. Although the following descriptions refer to a single processor resource 530 and a single machine-readable storage medium, the descriptions may also apply to a system with multiple processor resources and multiple machine-readable storage mediums. In such examples, the controller 504 may be distributed across multiple machine-readable storage mediums and across multiple processor resources. Put another way, the instructions executed by the controller 504 may be stored across multiple machine-readable storage mediums and executed across multiple processors, such as in a distributed or virtual computing environment.

Processor resource 530 may be a central processing unit (CPU), a semiconductor-based microprocessor, and/or other hardware devices suitable for retrieval and execution of machine-readable instructions 534, 536, 538 stored in a memory resource 532. Processor resource 530 may fetch, decode, and execute instructions 534, 536, 538. As an alternative or in addition to retrieving and executing instructions 534, 536, 538, processor resource 530 may include a plurality of electronic circuits that include electronic components for performing the functionality of instructions 534, 536, 538.

Memory resource 532 may be any electronic, magnetic, optical, or other physical storage device that stores executable instructions 534, 536, 538, and/or data. Thus, memory resource 532 may be, for example, Random Access Memory (RAM), an Electrically-Erasable Programmable Read-Only Memory (EEPROM), a storage drive, an optical disc, and the like. Memory resource 532 may be disposed within controller 504, as shown in FIG. 5. Additionally, memory resource 532 may be a portable, external or remote storage medium, for example, that causes controller 504 to download the instructions 534, 536, 538 from the portable/external/remote storage medium.

The controller 504 may include instructions 534 stored in the memory resource 532 and executable by the processor resource 530 to receive a signal from a GPU. The controller 504 may be, in some examples, a timing controller. The signal from the GPU can define a static image area and a moving image area of a display panel.

The controller 504 may include instructions 536 stored in the memory resource 532 and executable by the processor resource 530 to cause, based on the signal, a first portion of image data to be sent to a first pixel on a moving image area of the display panel at a first refresh rate over a plurality of frames in response to a TFT associated with the first pixel being on.

The controller 504 may include instructions 538 stored in the memory resource 532 and executable by the processor resource 530 to cause, based on the signal, a second portion of the image data to be sent to a second pixel on the static image area of the display panel at a second refresh rate over a plurality of frames. The second portion of image data can be static image data to be displayed on the static image area of the display panel. The controller 504 can cause the second portion of the image data to be sent at the second refresh rate over the plurality of frames by sending, in response to a second TFT associated with the second pixel being on, the second portion of the image data to the second pixel during a first frame of the plurality of frames. Further, the controller 504 can cause the second portion of the image data to be sent at the second refresh rate over the plurality of frames by preventing, in response to the second TFT being off, the second portion of the image data from being sent to the second pixel during a subsequent frame to the first frame.

The first refresh rate can be greater than the second refresh rate. For example, the controller 504 may cause the first portion of image data to be sent to the moving image area of the display panel every frame over a plurality of frames. However, the controller 504 may refrain from causing the second portion of image data to be sent to the static image area of the display panel every frame. Rather, the controller may cause the second portion of image data to be transmitted to the static image area of the display panel every third frame. Accordingly, the second refresh rate of the static image area can effectively be less than the first refresh rate of the moving image area.

Figure 6:
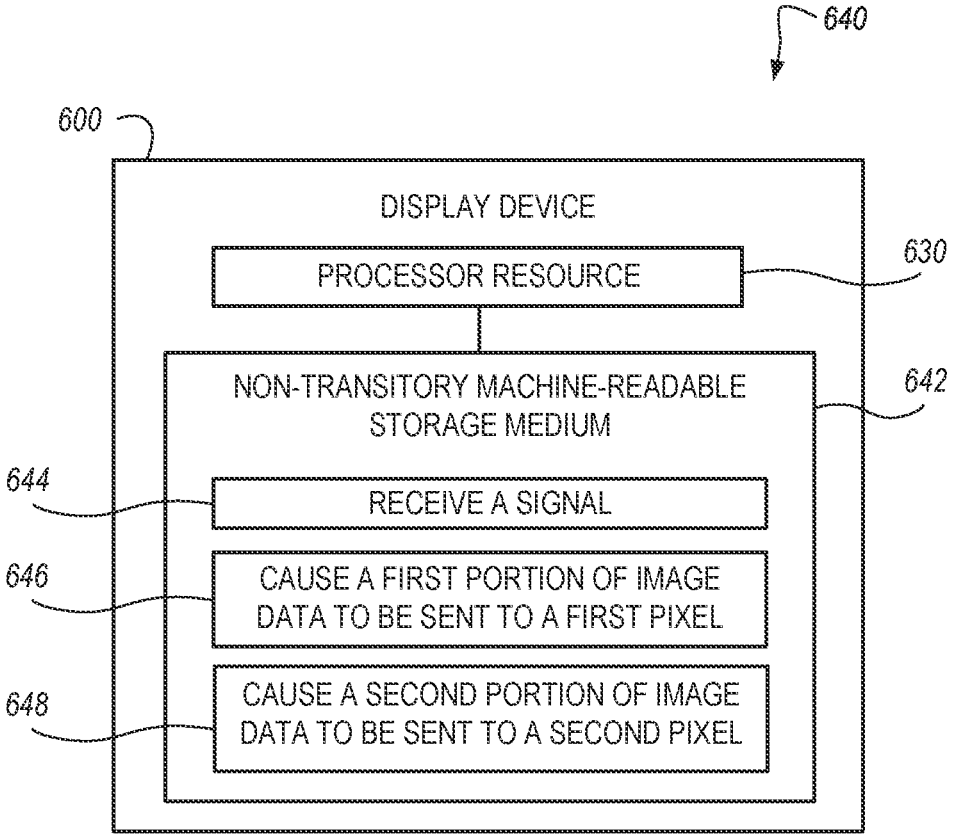
FIG. 6 is a block diagram of an example system for display panel area refresh rates consistent with the disclosure.

FIG. 6 is a block diagram of an example system 640 for display panel area refresh rates consistent with the disclosure. In the example of FIG. 6, system 640 includes a display device 600 including a processor resource 630 and a non-transitory machine-readable storage medium 642. Although the following descriptions refer to a single processor resource and a single machine-readable storage medium, the descriptions may also apply to a system with multiple processor resources and multiple non-transitory machine-readable storage mediums. In such examples, the instructions may be distributed across multiple machine-readable storage mediums and the instructions may be distributed across multiple processor resources, Put another way, the instructions may be stored across multiple machine-readable storage mediums and executed across multiple processor resources, such as in a distributed computing environment.

Processor resource 630 may be a central processing unit (CPU), microprocessor, and/or other hardware device suitable for retrieval and execution of instructions stored in the non-transitory machine-readable storage medium 642. In the particular example shown in FIG. 6, processor resource 630 may receive, determine, and send instructions 644, 646, 648. As an alternative or in addition to retrieving and executing instructions, processor resource 630 may include an electronic circuit comprising a number of electronic components for performing the operations of the instructions in the non-transitory machine-readable storage medium 642. With respect to the executable instruction representations or boxes described and shown herein, it should be understood that part or all of the executable instructions and/or electronic circuits included within one box may be included in a different box shown in the figures or in a different box not shown.

The non-transitory machine-readable storage medium 642 may be any electronic, magnetic, optical, or other physical storage device that stores executable instructions. Thus, the non-transitory machine-readable storage medium 642 may be, for example, Random Access Memory (RAM), an Electrically-Erasable Programmable Read-Only Memory (EEPROM), a storage drive, an optical disc, and the like. The executable instructions may be "installed" on the system 640 illustrated in FIG. 6, The non-transitory machine-readable storage medium 642 may be a portable, external or remote storage medium, for example, that allows the system 640 to download the instructions from the portable/external/remote storage medium. In this situation, the executable instructions may be part of an "installation package".

Receive instructions 644, when executed by a processor resource such as processor resource 630, may cause system 640 to receive a signal from a GPU. The signal from the GPU can define a static image area and a moving image area of a display panel.

Cause instructions 646, when executed by a processor resource such as processor resource 630, may cause system 640 to cause, based on the signal, a first portion of image data to be sent to a first pixel on a moving image area of a display panel at a first refresh rate over a plurality of frames in response to a first TFT associated with the first pixel being on. The first portion of image data can be moving image data to be displayed on the moving image area of the display panel and can be transmitted to the moving image area every frame of the plurality of frames.

Cause instructions 648, when executed by a processor resource such as processor resource 630, may cause system 640 to cause, based on the signal, a second portion of the image data to be sent to a second pixel on a static image area of the display panel at a second refresh rate. The second portion of the image data can be sent to a second pixel at the second refresh rate by sending, in response to a second TFT associated with the second pixel being on, the second portion of the image data to the second pixel during the first frame of the plurality of frames, and preventing, in response to the second TFT being off, the second portion of the image data from being sent to the second pixel during a subsequent frame to the first frame. The second portion of image data can be static image data to be displayed on the static image area of the display panel and can be transmitted to the static image area every third frame, for example.

Since the first portion of image data (e.g., the moving image data) can be transmitted every frame and the second portion of image data (e.g., the static image data) can be transmitted every third frame, the refresh rate of the moving image area of the display panel can be greater than the refresh rate of the static image area of the display panel.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 100 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure, and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. A controller, comprising:

a processor resource; and a non-transitory memory resource storing machine-readable instructions stored thereon that, when executed, cause the processor resource to;

receive a signal from a graphics processing unit (GPU);

cause, based on the signal, a first portion of image data to be sent to a first pixel on a moving image area of the display panel at a first refresh rate over a plurality of frames in response to a first thin film transistor (TFT) associated with the first pixel being on; and cause, based on the signal, a second portion of the image data to be sent to a second pixel on a static image area of the display panel at a second refresh rate over the plurality of frames by:

sending, in response to a second TFT associated with the second pixel being on, the second portion of the image data to the second pixel during a first frame of the plurality of frames; and preventing, in response to the second TFT being off, the second portion of the image data from being sent to the second pixel during a subsequent frame to the first frame.

2. The controller of claim 1, wherein the processor resource is to transmit a select signal to the second TFT to cause the second TFT to be on during the first frame.

3. The controller of claim 2, wherein the processor resource is to refrain from transmitting the select signal to the second TFT during the subsequent frame to cause the second TFT to be off.

4. The controller of claim 1, wherein the processor resource is to cause, in response to a data voltage being above a threshold voltage, the second TFT to be on.

5. The controller of claim 4, wherein the processor resource is to cause, in response to the data voltage being below the threshold voltage, the second TFT to be off.

6. A non-transitory machine-readable storage medium having stored thereon machine-readable instructions to cause a processor resource to:

receive a signal from a graphics processing unit (GPU);

cause, based on the signal, a first portion of image data to be sent to a first pixel on a moving image area of a display panel at a first refresh rate over a plurality of frames in response to a first thin film transistor (TFT) associated with the first pixel being on;

cause, based on the signal, a second portion of the image data to be sent to a second pixel on a static image area of the display panel at a second refresh rate over the plurality of frames by:

sending, in response to a second TFT associated with the second pixel being on, the second portion of the image data to the second pixel during the first frame of the plurality of frames; and preventing, in response to the second TFT being off, the second portion of the image data from being sent to the second pixel during a subsequent frame to the first frame;

wherein the first refresh rate is greater than the second refresh rate.

7. The medium of claim 6, wherein the first portion of the image data includes moving image data.

8. The medium of claim 6, wherein the second portion of the image data includes static image data.

9. The medium of claim 6, wherein the processor resource is to cause the second portion of the image data to be displayed on the static image area during the plurality of frames.

10. A display device, comprising:

a display panel including:

a first pixel connected to a graphics processing unit (GPU) via a first thin film transistor (TFT); and a second pixel connected to the GPU via a second TFT; and a timing controller, wherein the timing controller is to:

receive a signal from a graphics processing unit (GPU);

cause, during a first frame of a plurality of frames:

a first portion of image data to be sent to the first pixel of the display panel to be displayed on a moving image area of the display panel in response to the first TFT being on; and a second portion of the image data to be sent to the second pixel of the display panel to be displayed on a static image area of the display panel in response to the second TFT being on;

cause, during a second frame of the plurality of frames, the first portion of the image data to be sent to the first pixel in response to the first TFT being on; and prevent, during the second frame, the second portion of the image data from being sent to the second pixel in response to the second TFT being off.

11. The display device of claim 10, wherein the timing controller is to cause, during a different frame of the plurality of frames, the first portion of the image data to be sent to the first pixel to be displayed on the moving image area.

12. The display device of claim 11, wherein the timing controller is to cause, during the different frame, the second TFT to be on to cause the second portion of the image data to be sent to the second pixel to be displayed on the static image area.

13. The display device of claim 11, wherein the different frame is subsequent to the second frame.

14. The display device of claim 10, wherein the signal from the GPU defines the static image area and the moving image area on the display panel.

15. The display device of claim 10, wherein an amount of times the display panel is refreshed per second defines a refresh rate of the display panel.

* * * * *